US005366094A

United States Patent [19]

Stein

[11] Patent Number: 5,366,094

[45] Date of Patent: Nov. 22, 1994

[54] WIND TUNNEL FOR CLEANING AND CLASSIFYING SOLID PARTICLE FORM MATERIAL

[75] Inventor: Peter Stein, Caracas, Venezuela

[73] Assignee: Grana, Inc; New York, N.Y.

[21] Appl. No.: 135,742

[22] Filed: Dec. 6, 1993

Related U.S. Application Data

[63] Continuation-in-part of Ser. No. 872,603, Apr. 23, 1992, Pat. No. 5,281,278.

[51] Int. Cl.[5] ..... B08B 5/00; B07B 4/00; B07B 7/00

[52] U.S. Cl. ..... 209/138; 209/139.1; 209/142; 134/25.1

[58] Field of Search ..... 134/25.1; 209/140, 141, 209/142, 138, 139.1, 134, 135

[56] References Cited

U.S. PATENT DOCUMENTS

| | | | |
|---|---|---|---|
| 2,683,685 | 7/1954 | Matheson | 208/152 |
| 3,738,483 | 6/1973 | Mackenzie | 209/137 |
| 3,975,263 | 8/1976 | Elo | 209/154 |
| 4,127,476 | 11/1978 | Iannazzi | 209/138 |

*Primary Examiner*—Richard O. Dean
*Assistant Examiner*—Zeinab El-Arini
*Attorney, Agent, or Firm*—Cooper & Dunham

[57] ABSTRACT

A chamber has upwardly diverging walls so that an upward airstream has different air speeds at different heights in the chamber. When particles such as seeds are put into the chamber, they reach equilibrium at different heights depending on their weights. A horizontal conveyor airstream, much less in magnitude than the upward airstream, directs the classified-by-height particles to a side wall of the chamber, where they are removed.

35 Claims, 9 Drawing Sheets

WIND TUNNEL FOR CLEANING AND CLASSIFYING SOLID PARTICLE FORM MATERIAL

The present application is a continuation-in-part of U.S. Ser. No. 07/872,603 filed Apr. 23, 1992 now U.S. Pat. No. 5,281,278.

BACKGROUND OF THE INVENTION

The present invention relates to a method or apparatus for cleaning and classifying solid particles having different sizes or weights, particularly seeds and grains.

There has always been a need to separate or classify material having solid particles of different sizes, weights, shapes or densities into various fractions.

In the processing of seeds, such as sesame seeds, it has been found that the impurity content of a crop delivered to a cleaning and processing plant is typically between 5 and 15%. The impurity content depends largely on climatic conditions during the corp. Good maintenance of the plantation and adequate storage in the farm contribute to lower content of impurities.

The composition by weight of the common impurities in a typical sesame seed harvest is as follows: seeds, 38.60%; leaves, 1.20%; stems, 50.80%; fibered particles 0.03%; earthy stones, 2.70%; grits, 0.24%; metallic particles, 0.09%; animal excrements, 2.30%; dead insects, 4.00%; and insect eggs, 0.04%.

One device used to remove impurities from seed crop is an airscreening cleaner. Such a device has a first stack of meshes arranged in parallel but inclined slightly to the horizontal. Material is deposited on the top mesh in the stack and has the largest mesh clearance, to collect the large impurities such as leaves and stems while allowing seeds and other smaller impurities to fall through the mesh. A second mesh beneath the top mesh has a medium mesh clearance and removes impurities in the same manner. A lower mesh having a relatively small mesh clearance allows small impurities to fall through, while retaining the medium-sized material for further processing. The medium-sized material is then processed through a second stack of meshes having a closer range of mesh sizes.

Using such a machine, it has been found that the vegetable content of the impurities is about 90% of global impurity, the animal impurity about 7% of global impurity and the mineral content about 3% of global impurity. The mammal and insect excrement in the unclean material is typically about 2.3% of the global impurities, which is equivalent to about 1000 mg. (1 gram) of excrement per pound of seeds for averaged global impurities of about 10%.

The U.S.D.A. and A.S.T.A. (American Spice Trading Association) maximum tolerance of mammalian excrement in sesame seeds is only 5 mg./lb. While the U.S.D.A. and A.S.T.A. set a maximum foreign matter content of 0.5%, which is equivalent to 99.5% purity, the results indicate that in order to meet the required level of 1–5 mg./lb. of excrement/seed, a theoretical purity of 99.9% appears to be required. This would equate to reducing the trash or impurity content to 1% of its an initial content, a very difficult task.

One method of removing further impurities from seeds (after much of the impurities have been removed using an airscreening cleaner as described above) is by using a gravity table. Such devices claim to have a capacity of about 3500 lb./hr. for sesame seeds, no claim being made regarding purity. By feeding relatively clean material having an initial purity rate of 99.3–99.6% into such a cleaner, a final purity rate of 99.8% may be achieved. However, this rate is achieved after recycling the material one or two times, and at a capacity of only about 500–600 lb/.hr., much less than 3500 lb./hr. Such an arrangement would require many machines working both in series and in parallel (to avoid a bottleneck in production) to achieve an acceptable purity rate at a relatively high production capacity, requiring a high investment cost. Moreover, repeated recycling of the seed product results in mechanical fatigue of the seeds and grains, increasing the quantity of broken seeds/grains in the product and thereby actually resulting in an increase in impurity matter (the broken seeds) which must be removed. Thus recycling in an attempt to increase purity is in a sense counter productive. Further, the broken seeds often increase the acidity and cause the product to deteriorate.

There is thus a need to provide a cleaner and classifier arrangement which provides a high purity content of seeds and grains at a high capacity, with a limited investment.

SUMMARY OF THE INVENTION

According to the present invention, a method and apparatus for cleaning and classifying solid particles is provided.

Advantageously, the invention provides for superposition of two generally perpendicular airflows in a wind tunnel or chamber. The first airflow or airstream is a vertical suspension whose speed varies with height but whose speed is relatively constant or homogenous in any horizontal plane. This first airstream classifies the particles at different heights. The second airflow is a horizontal conveyor-stream acting to convey the classified particles horizontally to outlet channels where they are collected.

According to one form of the invention, an apparatus for cleaning and classifying solid particles having different weights is provided comprising a vertical chamber having a top, bottom and side walls, means for introducing particles of different weights into the chamber, means for creating a vertically upward suspension airstream in the chamber whose air speed varies with height, to thereby classify the particles by weight at different heights, a plurality of outlet channel means arranged vertically along the side wall of the chamber for removing particles classified by weight, and means for creating a horizontal conveyor airstream into the chamber to direct the suspended, classified particles toward the respective outlet channel means.

The vertical chamber preferably has a cross-sectional area which increases in the upward direction, so that the lighter particles are suspended at a height higher than the heavier particles. The apparatus preferably comprises a top converging section connected to the top of the vertical chamber and outlet means at the top of the converging section for collecting and removing particles lighter than particles suspended at the top of the vertical chamber. The vertical chamber preferably comprises four side walls comprising two generally parallel walls and two upwardly diverging walls connected to the parallel walls.

The cross-sectional area at the top of the chamber is preferably about two times the cross-sectional area at the bottom of the chamber, to thereby provide a vertical air speed at the bottom of the chamber about two times the vertical air speed at the top of the chamber.

The particles may be introduced into the chamber through an inlet at the bottom of the chamber. The means for creating a vertically upward airstream may comprise a suction fan in communication with the top of the chamber. The vertical airstream is preferably at least one order of magnitude greater than the horizontal airstream, and in one preferred form is about 40 times greater than the horizontal airstream.

The plurality of outlet channel means may comprise a plurality of outlet channels, e.g. eight in number, vertically arranged along the side wall of the vertical chamber, and outlet collectors connected to the respective outlet channels for collecting the classified particles. The particles which are classified may be seeds or grains.

The chamber preferably includes transparent windows in the side wall for observing the particles in the airstreams.

Means may be provided for adjusting the speed of the vertical airstream and for adjusting the speed of the horizontal airstream.

Collection means may be provided at the bottom of the vertical chamber in the form of downwardly diverging walls for collecting and removing relatively heavy particles which do not become suspended in the vertical airstream.

The top converging section may comprise a plurality of top converging subsections all of which are connected at their respective upper regions.

According to another aspect of the invention, a method for cleaning and classifying solid particles having different weights is provided, comprising introducing particles of different weights into a vertical chamber, creating a vertically upward airstream in the chamber whose air speed varies with height to thereby suspend the particles having different weights at different respective vertical heights, creating a horizontal airstream in the chamber for directing the suspended classified particles toward an inner side wall of said chamber, and removing the classified particles from the chamber at different vertical heights.

The vertical chamber preferably has an upwardly diverging cross-sectional area, so that the lighter particles are suspended higher than the heavier particles.

The method preferably includes further comprising providing a top converging section connected to the top of the chamber, and collecting and removing relatively light particles entering the top converging section.

The vertical airstream is preferably at least one order of magnitude greater than the horizontal airstream. The chamber preferably has a cross-sectional area at its top which is about twice the cross-sectional area at its bottom to provide an upwardly vertical air speed twice the speed at the chamber bottom than at the top. The particles may be seeds or grains.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF THE PREFERRED EMBODIMENT

While a preferred embodiment will be described using seeds or grains as the particles, the particles could be any particle whose floating capacity in a fluid bed is distributed on the basis of its weight, (other factors such as shape, size and specific volume being equal) indifferently of the chemical or material composition of the solid particle.

Figure 1B:
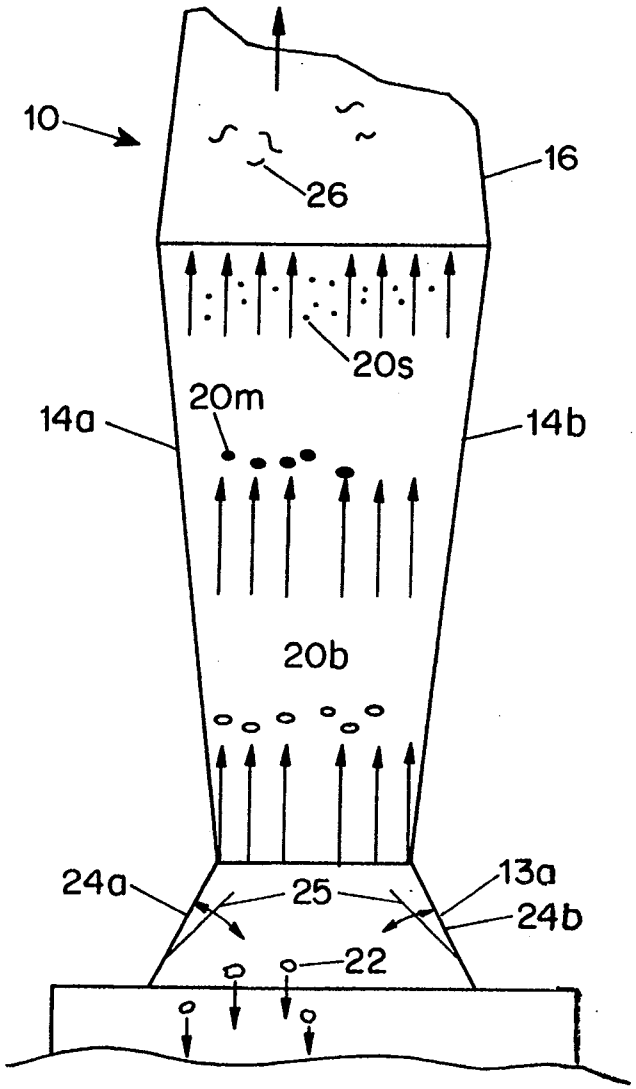
FIG. 1B is a side elevational view of the cleaner and classifier shown in FIG. 1A.
Figure 1A:
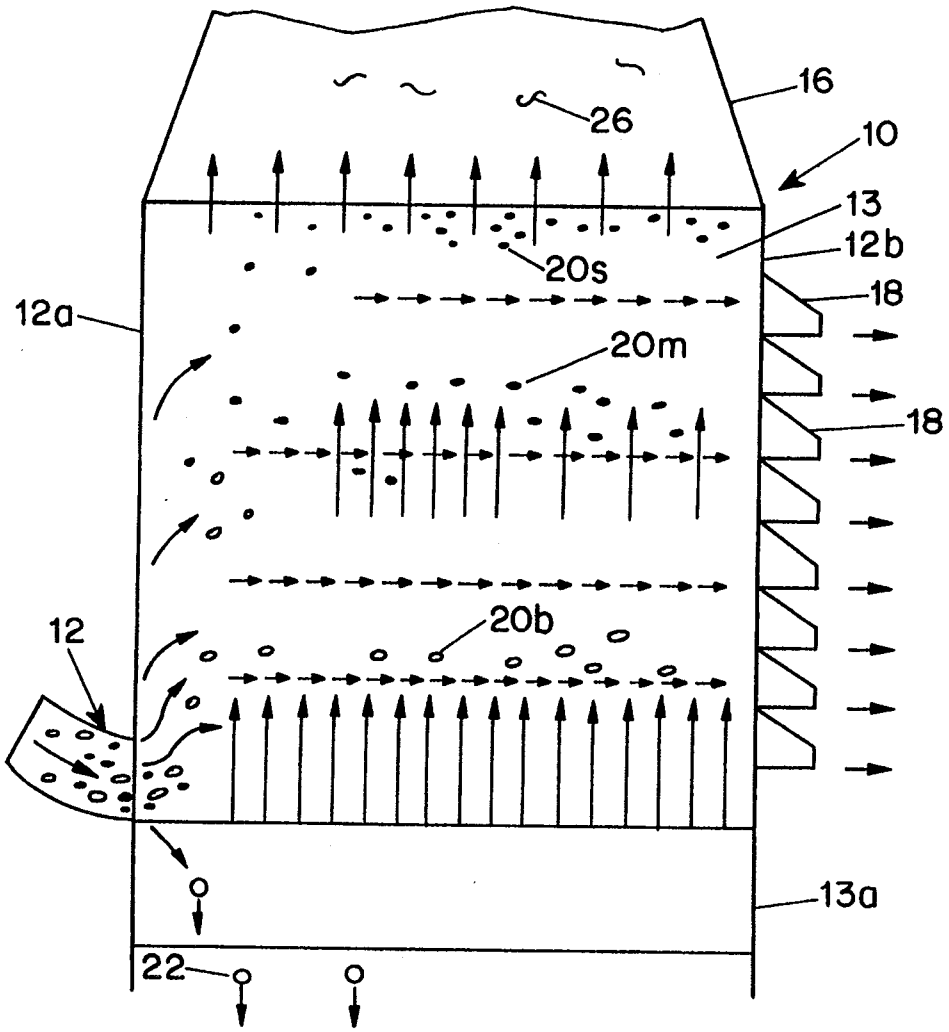
FIG. 1A is a front elevational view, in schematic form of a cleaner and classifier according to the invention.

The general concept of the invention will be described with reference to FIGS. 1A and B, which show, in schematic form, the concepts of the present invention. FIG. 1A shows a side view of a cleaner and classifier 10 according to the present invention, whereby an inlet 12 is shown at the bottom for providing solid particles, such as seeds, having different masses or weights.

As shown in FIG. 1A, the chamber has generally parallel vertically oriented side walls 12*a* and 12*b*. However, as shown in FIG. 1B, a chamber 13 has upwardly diverging front and back walls 14*a* and 14*b*. At the top of the chamber 13, a top converging section 16 is provided connected to the top of the vertical chamber 13. As shown in FIG. 1A, a plurality of outlet channels 18, in this case 8, are provided along the side wall 12*b* of the chamber 13 for removing particles classified by mass or weight in a manner to be described below.

The device 10 includes means for creating a vertically upward suspension airstream as shown by the upward arrows in FIGS. 1A and 1B. The suspension stream is on the order of 10,000–20,000 cfm, the particular value depending on the type of seed, grain or particle. For sesame seeds, a stream of about 10,000 cfm. is believed to be acceptable. Due to the upwardly diverging front and back walls of the chamber 13, the magnitude of the upward air speed varies with height, to suspend the particles at different heights and classify them by mass or weight, with the lighter particles being suspended above the heavier particles. In the case where the particles are seeds, small seeds 20*s* will be suspended at the top of the chamber 13, medium seeds 20*m* at the middle and big seeds 20*b* floated at the bottom of the chamber 13. Heavier material 22 such as stones or other heavy debris will be removed at the bottom of the chamber 13 in section 13*a* by means of downwardly diverging walls 24*a* and 24*b* which arrangement serves to create an air speed which increases in the upward direction, whereby heavier materials such as the stones fall downward.

A pair of baffles 25 are provided at the bottom of the chamber. The baffles pivot as shown, and selection of their position will enable one to vary the ratio of the vertical air speed at the bottom of the chamber relative to the top of the chamber.

Due to the top converging section 16 at the top of the vertical chamber 13, relatively light debris 26 such as leaves and twigs will be pulled out of the top of the chamber 13 for disposal. Thus, the arrangement not only provides for the removal of relatively light debris 26 and relatively heavy debris 22 at the respective top 16 and bottom section 13*a* of the chamber, but also classifies the relatively small (20*s*), medium (20*m*) and big (20*b*) mass or weight particles at the top, medium and bottom of the chamber, respectively.

Also provided is a means for creating a horizontal conveyor airstream in the chamber 13 for directing the suspended, classified particles horizontally toward the respective outlet channels 18. The conveyor airstream is much less than the suspension vertical stream, and is preferably on the order of 300 cfm, or about 3–5% of the vertical stream. The horizontal conveyor airstream will thus continually drive the vertically classified particles toward the outlet channels 18 where they are collected and removed.

Figure 2A:
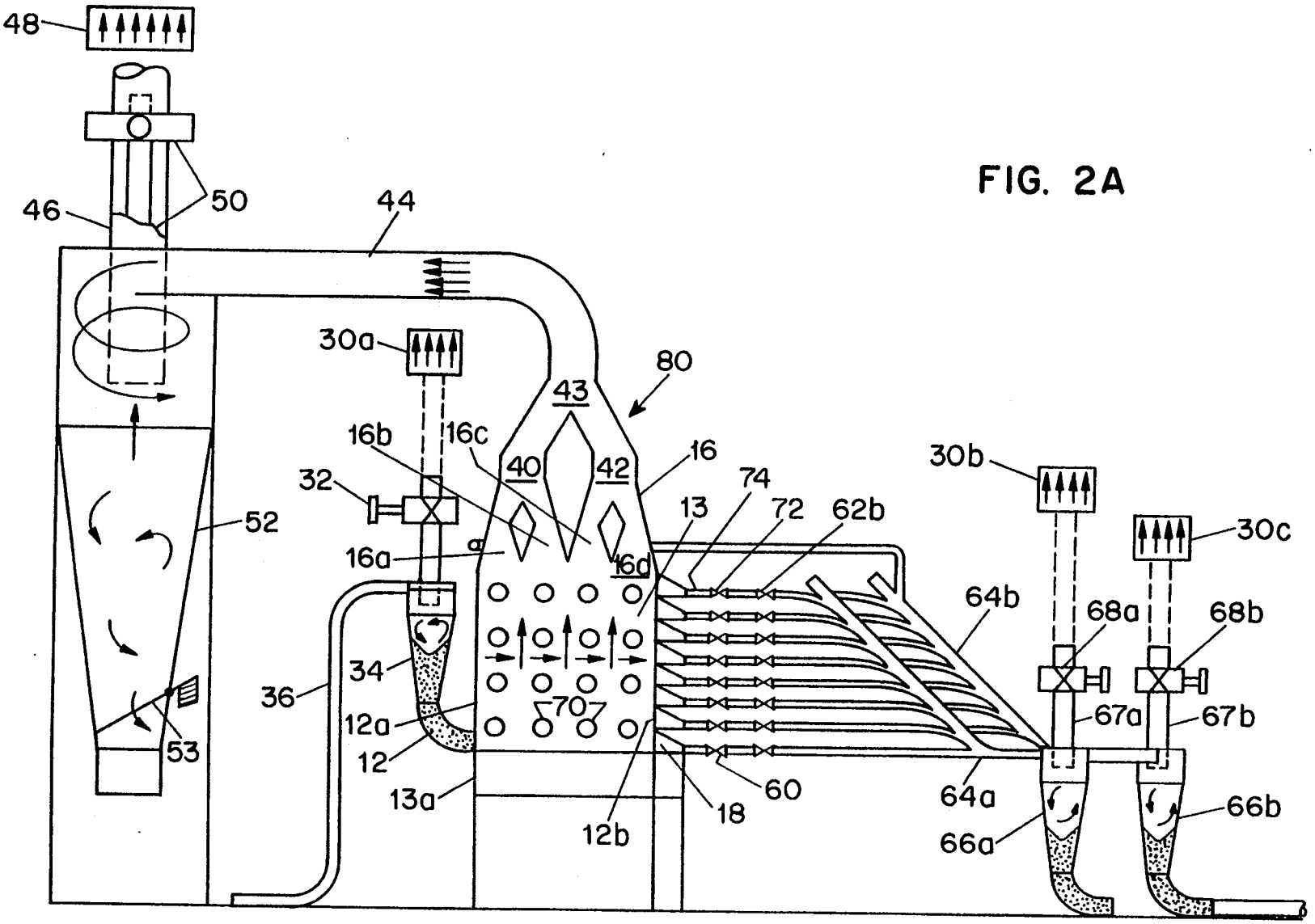
FIG. 2A is a front elevational view, in cross-section of a cleaner and classifier according to the invention.
Figure 2B:
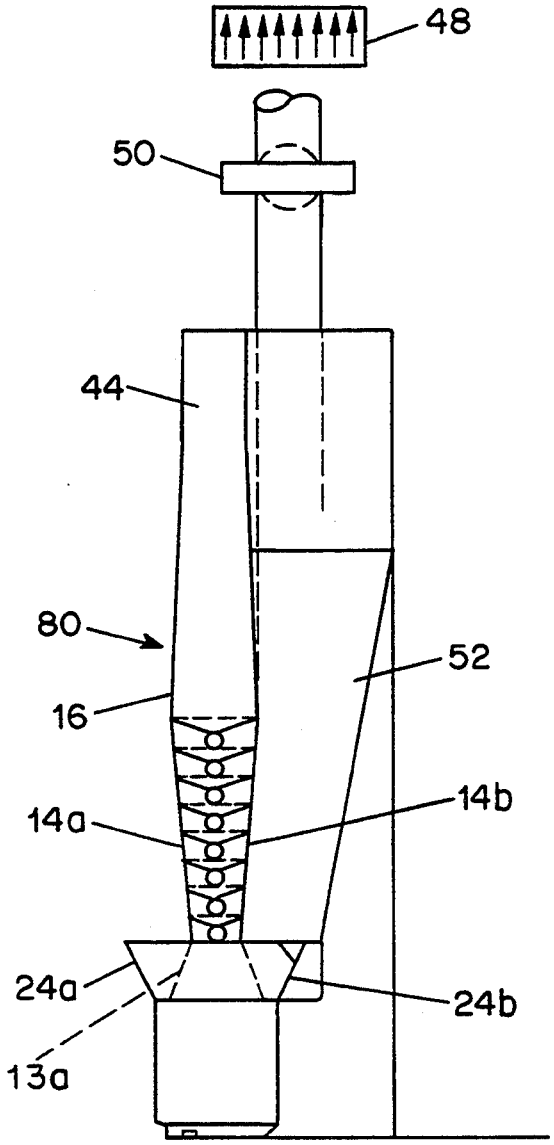
FIG. 2B is a side elevational view of the cleaner and classifier of FIG. 2A.
Figure 2C:
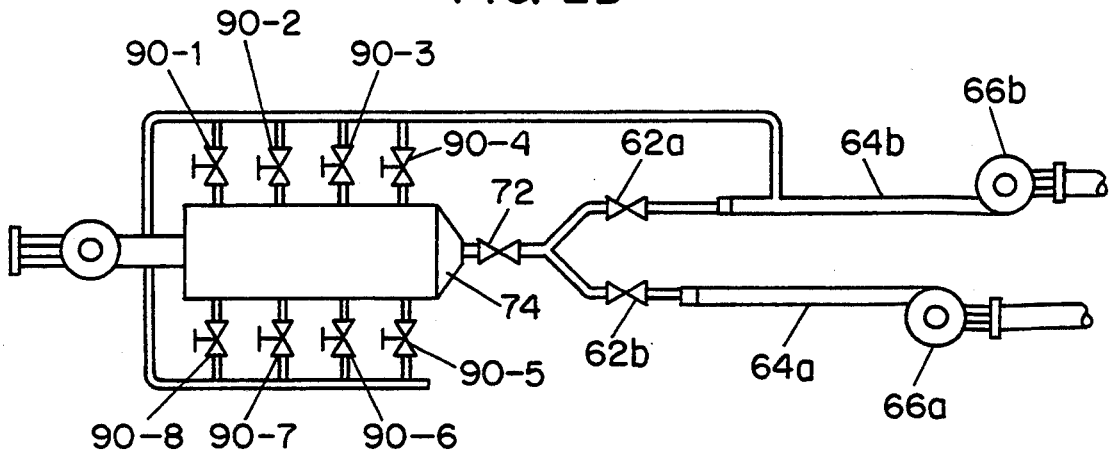
FIG. 2C is a top plan view of the cleaner and classifier of FIGS. 2A and 2B.

A more detailed illustration of the preferred embodiment according to the invention is shown in FIGS. 2A, 2B and 2C. As shown in FIG. 2A the cleaner and classifier according to the invention comprises a vertical chamber 13 having vertical parallel side walls 12*a* and 12*b*, but as shown in FIG. 2B, has upwardly diverging front and back walls 14*a* and 14*b*. The four walls together define a cross-section which increases in the upward direction. The cross-section at the top of the chamber 13 is about twice that at the bottom of the chamber 13. This ratio of about two to one in cross-sectioned area will encompass a large spectrum in seed size. Of course, the ratio may be made larger or smaller to increase or decrease the spectrum.

At the bottom of the chamber 13 is a particle material inlet means 12 for feeding particle material into the chamber 13. At the top of the inlet means 12 is a fan 30*a* having a flow rate of about 300 cfm which is connected through a control valve 32 to control the suction or the infeed rate of the material. It should be understood that the fan 30*a* is shown merely schematically at the position shown, and may be preferably mounted on the floor. The bottom of the inlet means is an inverted frustro-conical tube or cyclone member 34 which houses the particle material in the lower end, but because of the fan 30*a* has a cyclone airstream. Connected to this cyclone member 34 is a feed tube 36 for supplying the particle material to the inlet means 12. The fan 30*a* also serves to deliver the particle material from the feed tube 36 to the cyclone member 34.

Disposed at the top of the chamber 13 is a top converging section comprising four sub-sections 16*a*, 16*b*, 16*c* and 16*d*. The two leftmost subsections 16*a* and 16*b* are connected by a left union 40 and the two rightmost subsections 16*c* and 16*d* are connected by a right union 42. The two left subsections and left union are symmetrical to the two right subsections and union. A further Y-coupling 43 connects the left union 40 and right union 42 which communicates with an outlet tube 44. The outlet tube 44 is connected tangentially to a trash cyclone 52, so that the air entering the cyclone initially flows downward in the direction of the upper circular arrow, carrying with it the lighter debris 26. This debris collects at the bottom of the cyclone 52, where a weight regulated trap door 53 opens when enough debris accumulates to drop the debris out of the cyclone. The air exits the cyclone through a suction pipe 46 which at its upper end is connected to suction fan 48 having a 10,000–20,000 cfm capacity through a damper 50.

The suction fan 48, when the damper 50 is at least partially open, creates a suction or upward draft in the chamber 13 which floats the particle material according to mass or weight at different varying levels. This is because of the shape of the chamber 13 which has upwardly diverging walls 14*a* and 14*b* whereby the air speed at the bottom of the chamber is more than the air speed at the top of the chamber. The different mass or weight particles will thus float at different levels as described with reference to FIG. 1A.

Means are provided for creating a horizontal conveyor stream which drives the classified floating particles horizontally towards the respective right side wall 12*b* of the chamber 13 as shown in FIG. 2A. Disposed at the right side of FIG. 2A is a plurality, in this case 8, outlet channels 18 which receive and collect the particle material at that particular vertical level. Each channel 18 has a respective regulating valve 60 and two switch valves 62*a* and 62*b* for connecting the respective channel to an A channel or a B channel pipe collector 64*a* and 64*b*. Of course, additional collectors 64*c*, etc. (not shown) may be provided, with corresponding switch values 62*c*, etc. to allow three or more grades of collection. This is useful for diverting the particular particles in each respective channel after they have been inspected for grade or quality or the like. The outputs of the A and B channels 64*a* and 64*b* are then provided to respective outlet cyclones 66*a* and 66*b*. Rising upwardly from cyclones 66*a* and 66*b* are vertical pipes 67*a* and 67*b*, which are connected through respective control valves 68a and 68b to fans 30b and 30c, the fans being shown schematically. The fans 30b and 30c provide a means to create the horizontal conveyor airstream, and the respective control valves 68a and 68b enable one to regulate the conveyor air speed. Of course, the fans 30b and 30c may be located elsewhere, and may be actually one fan with fan 30a.

The chamber 13 further has watching windows 70 whereby an operator can observe the classification process and adjust the upward airstream and horizontal conveyor airstream by adjusting damper 50 and valves 68a, 68b and 60 to obtain the best classification results.

Although the invention is not limited thereto, the preferred embodiment may have a bottom width in the chamber 13 of about 0.4 meters, a top width of about 0.75 meters, and a speed ratio on the order of 1.9 or 2.0 (which is a ratio of the top width and bottom width). Hence, particles or seeds of different weight can be suspended and collected into the different channels 18.

Couplings 72 are also provided just after the channel end cones 74 for enabling an operator to physically inspect and sample the classified material to determine its grade and selecting either the A or the B channels 64a or 64b, by means of switching valves 68a and 68b.

Due to the nature of the upwardly converging top portion 16, once the lighter weight material or debris crosses over the boundary separating the main part of the chamber (having upwardly diverging walls) to the upper top portion 1b (having upwardly converging walls), the lighter material 26 will be accelerated through the symmetric roof section 30 out into the trash cyclone 52, thereby providing a cleaner grade of classified material. In a similar manner, the bottom downwardly diverging wall arrangement at the bottom section 13a of the chamber 13 serves to remove relatively heavy material 22 such as stones or the like.

The apparatus according to the invention will not only clean and classify the seeds or particles into eight categories (or more or less depending upon the number of channels desired) according to size, but it may also sort out seeds or particles of different color if the color difference is related to a difference in specific weight, size or shape. As can seen in FIG. 1A, the width of the chamber 13 is divided into four equal subsections corresponding to the subsections 16a, 16b, 16c and 16d of the top portion, whereby the same suction force or upstream flow is the same in all four subsections. Small discrepancies may be corrected for by means of four or more (in this case eight) valves 90-1 to 90-8. In this case two valves are provided for each subsection, but one or more than two may be provided for each subsection.

Figure 3A:
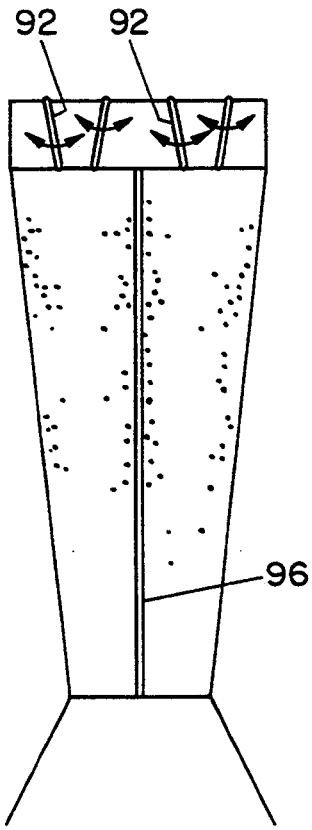
FIG. 3A is a partial front elevational view, similar to FIG. 2A, showing axial baffles.
Figure 3B:
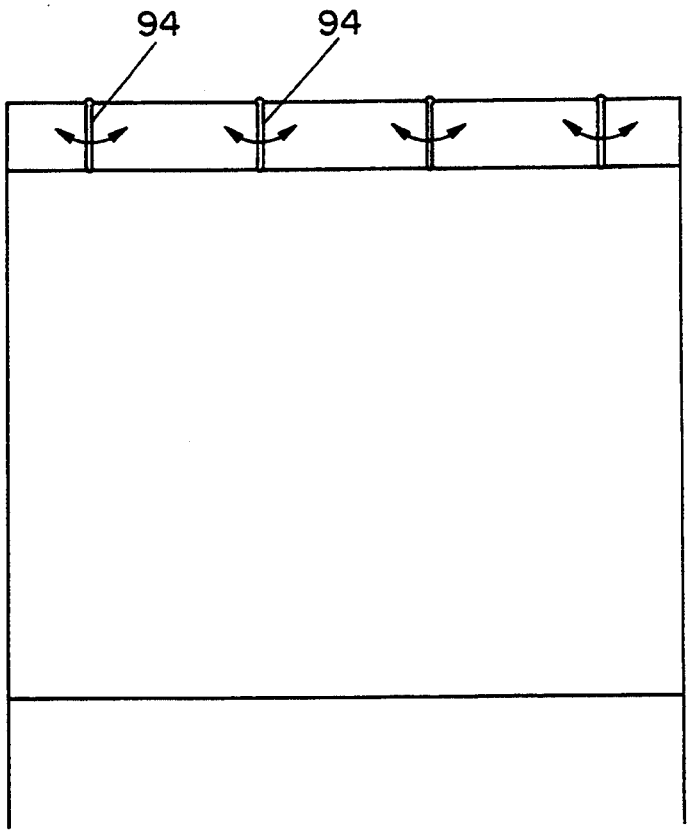
FIG. 3B is a partial side elevational view, similar to FIG. 2B, showing transverse baffles.

As shown in FIGS. 3A and 3B, axial baffles 92 and transverse baffles 94 are arranged to pivot at their upper points and can be postionally adjusted to correct small discrepancies in suction force along the respective depth and length of the roof, to create uniformity of suction. A vertical sheet plate or wall 96 along the vertical symmetrical axis of the chamber may also be provided to limit the amplitude of vibration of the particles.

Figure 4A:
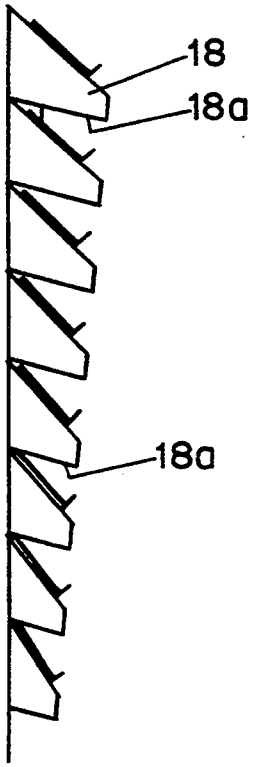
FIG. 4A is a partial elevational view, similar to FIG. 2A, showing an arrangement for outlet channels.
Figure 4B:
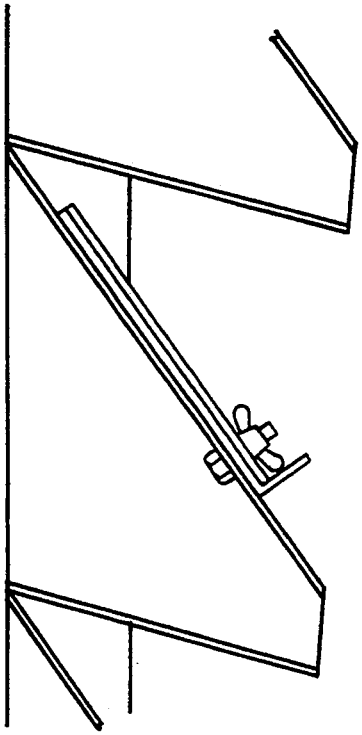
FIG. 4B is a front elevational view, showing an outlet channel of the FIG. 4A in more detail.
Figure 4C:
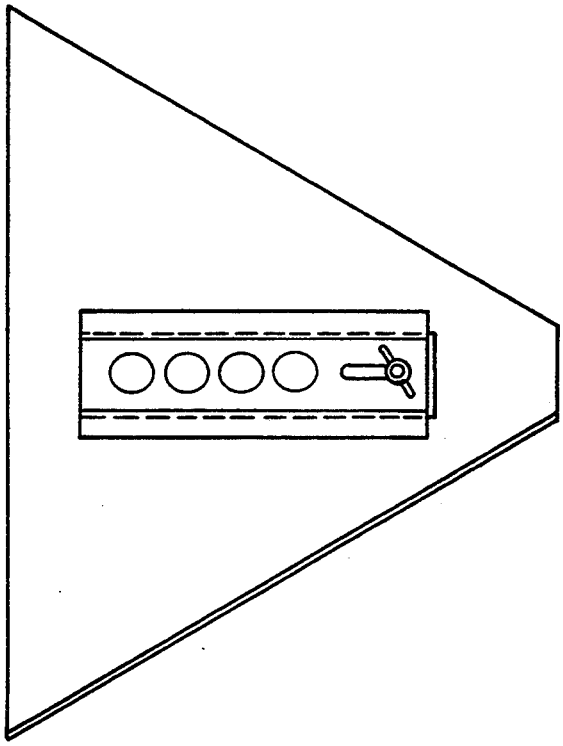
FIG. 4C is a top view of the outlet channel of FIG. 4B.

FIGS. 4A, 4B and 4C show an alternative and probably preferred arrangement for the channel collectors at the right side of the wind tunnel. Here the bottom walls 18a of the respective channels 18 are inclined slightly to facilitate suction of the particles into the corresponding suction pipes. The top walls 18b each have a sliding valve 18c, as shown in FIGS. 4B and 4C, to facilitate adjustable air inflow pushing the particles into the corresponding suction pipes, and also provide additional means to regulate flow rate in these pipes.

Figure 5A:
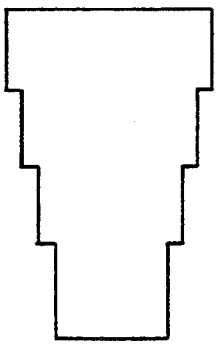
FIG. 5A, 5B, 5C and 5D are elevational views showing modified cross-sectional shapes of the chamber.
Figure 5B:
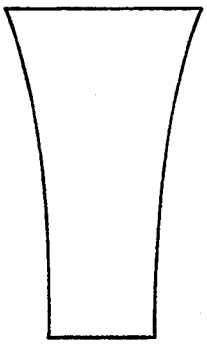
Figure 5C:
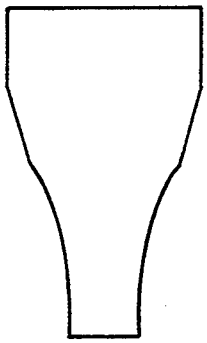
Figure 5D:
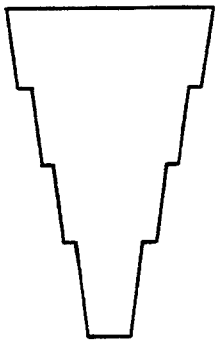

FIGS. 5A, 5B, 5C and 5D show alternative shapes for the chamber. FIG. 5A shows a stepwise arrangement with otherwise vertical walls; FIG. 5B shows inwardly curving walls (although outwardly curving walls could be used); FIG. 5C shows three wall portions—one straight, one inclined and one curved; FIG. 5D shows a stepwise arrangement with inclines between steps.

Figure 6A:
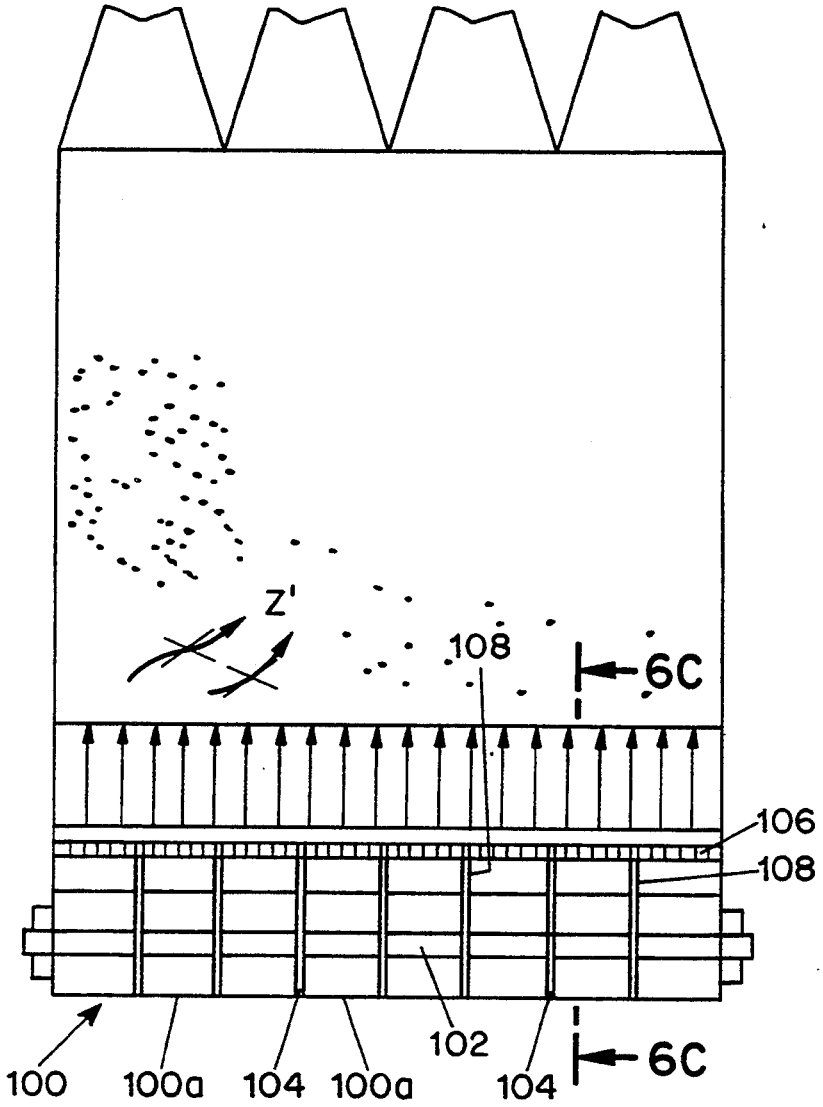
FIG. 6A is a front elevational view of an arrangement of incorporating a fanning flywheel.
Figure 6B:
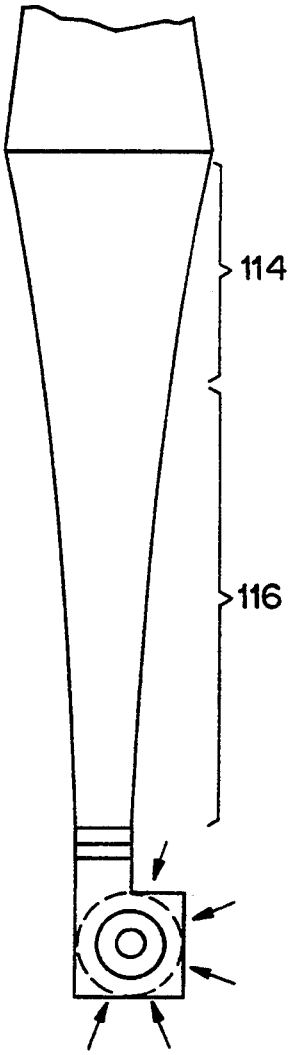
FIG. 6B is a side view of the FIG. 6A arrangement.
Figure 6C:
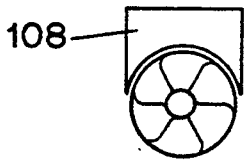
FIG. 6C is a partial cross-section taken along lines C-C of FIG. 6A.

FIGS. 6A, 6B and 6C show an arrangement which adds a fanning flywheel 100 to the chamber bottom. The fanning flywheel 100 has a number of segments 100a, in this case 8, for example, which are mounted on a common shaft 102, which segments are connected to rotate at the same speed. This arrangement secures homogenous air inflow all along the bottom inlet, in particular when strong flow disturbances (like for instance a high rate of material infeed at the left lower end) causes stream deviations and resulting in the generation of cyclic or non-cyclic waves in the tunnel. The segments 100a have as shown in FIG. 6C, radial blades, and disk plates 104 are disposed sandwichwise between the adjacent segments 100a to hinder any axial migration of the air. The rotation of the segments 100a (which as described above is at the same speed) is generated by the suction effect of the extraction fan at the end of the line. Hence the fanning flywheel is operated like a wind turbine and is a storehouse of kinetic energy, where the stored amount depends on its moment of inertia and speed of rotation.

A horizontal plate or screen 106 is located on top of the fanning flywheel 100 to create a barrier of air velocity hindering any fall of seeds or particles through the open bottom. The increased velocity (increased by a factor of 1.4–2.0) results from area contraction in the screen or plate. The clearances or square holes may be, e.g. 1"×1", and are wide enough to let stones fall through when the particles are seeds. Depending downward from the plate 106 are barriers 108 which are aligned above the disk plates 104 and have semi-circular lower edge as shown in FIG. C to create a dividers with the disk plates.

Figure 7C:
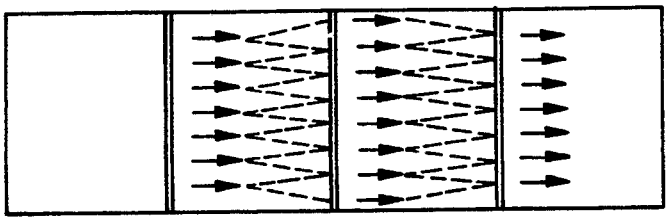
FIG. 7A is a front elevational view similar to FIG. 6A but also showing vertical plates.
FIG. 7B is a side view similar to FIG. 6B, but showing the plates of FIG. 7A.
Figure 7A:
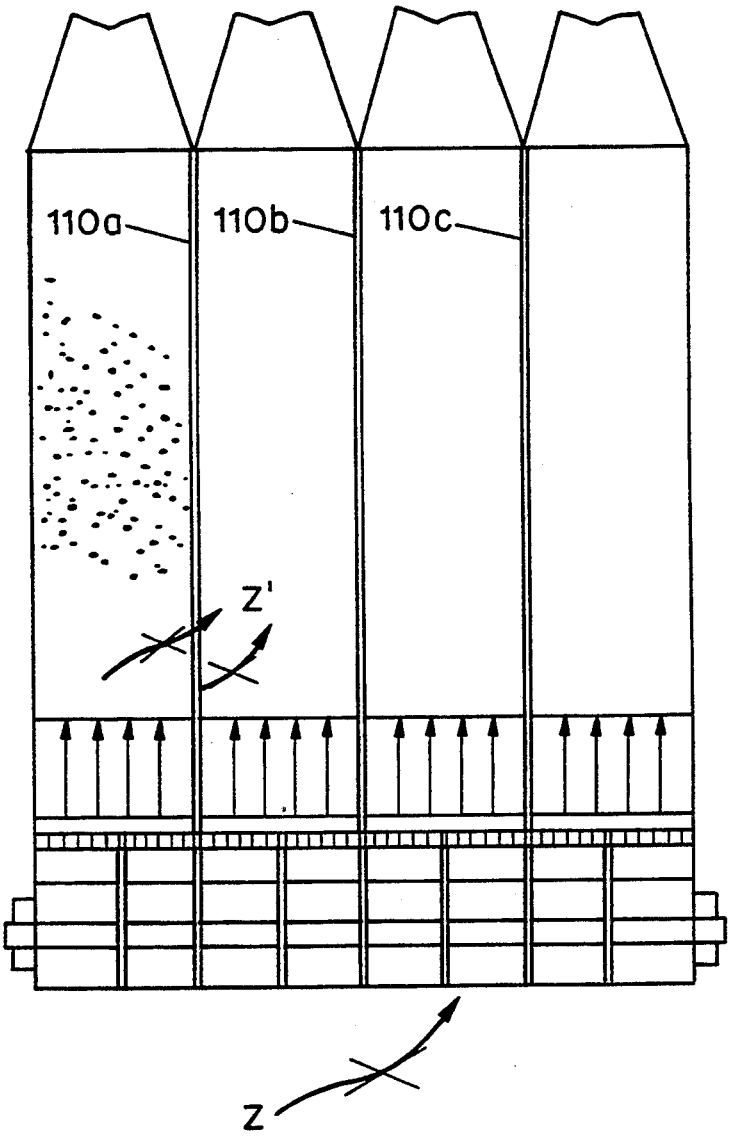
Figure 7B:
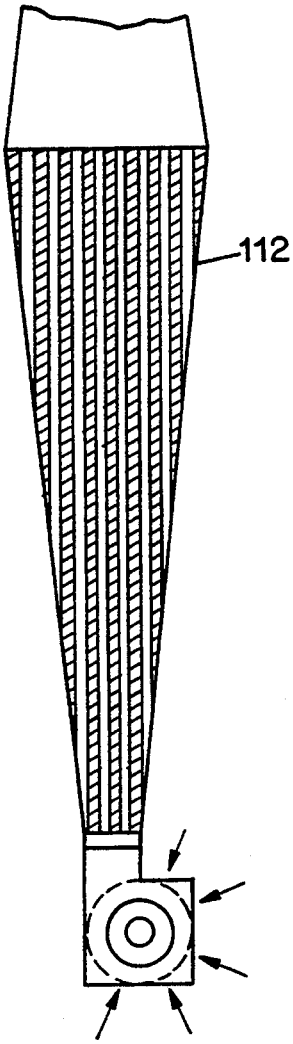

Once a homogenous air inflow along the bottom inlet is secured even in the event of the flow disturbances, the air within the tunnel may still prefer to stream around the obstacle or disturbance as shown by arrow Z'. As shown in FIG. 7A, to avoid this additional resistance to rightwards flow, a series of three (maybe less or more) vertical plates 110a, 110b and 110c may be provided, each plate having vertical slots 112 as shown in FIG. 7A. The slots 112 allow the horizontal flow of air and seeds. The global open area of the slots 112 is about 50% of the area of the vertical plate. These slotted plates act like wave breakers.

As shown in FIG. 6B, the lateral inclined walls of the tunnel may be linear with just one angle of inclination or may be divided into an upper and lower section where the walls of the upper section 114 have a slightly bigger angle of inclination than those in the lower section 116. The other arrangements of the FIGS. 5A, 5B, 5C or 5D, or variants thereof, may instead be used. The walls may be continuous or stepwise.

Figure 8:
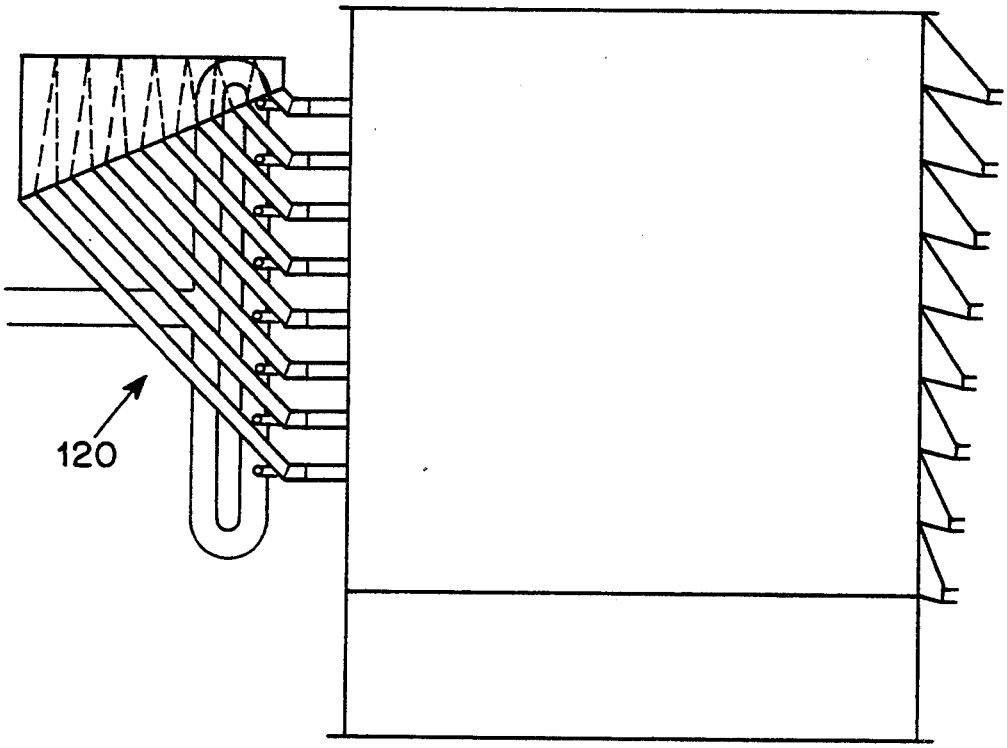
FIG. 8 is a front elevational view showing an alternate input distributor arrangement.

FIG. 8 shows an alternative, and probably preferred means of inputing material into the tunnel or chamber, by having a distributor 120 for receiving material at the top of hopper 122 and feeding it into the chamber sidewalls through a plurality, in this case 8, input pipes 130. FIG. 8 shows this arrangement in greater detail.

Figure 10:
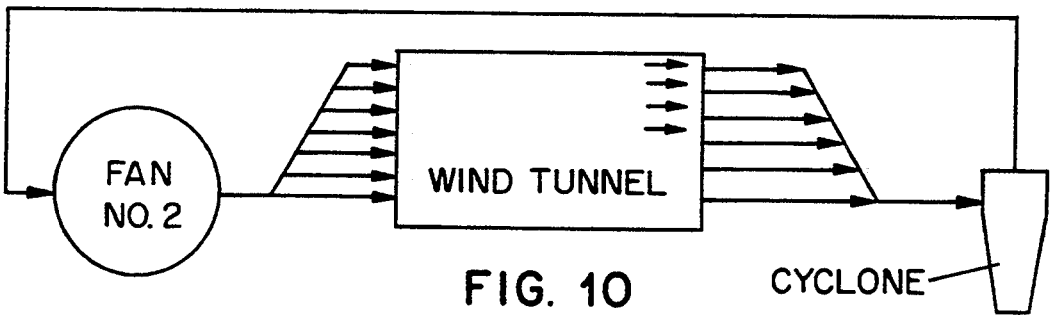
FIG. 10 shows a schematic arrangement for using one horizontal transport in a closed loop to recirculate the air.
Figure 11:
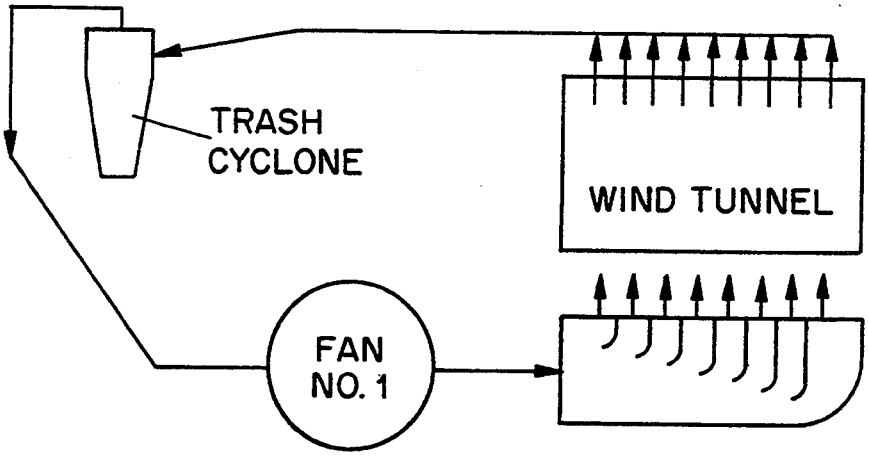
FIG. 11 shows a schematic arrangement for using one vertical suspension air fan in a closed loop to recirculate the air.
Figure 9:
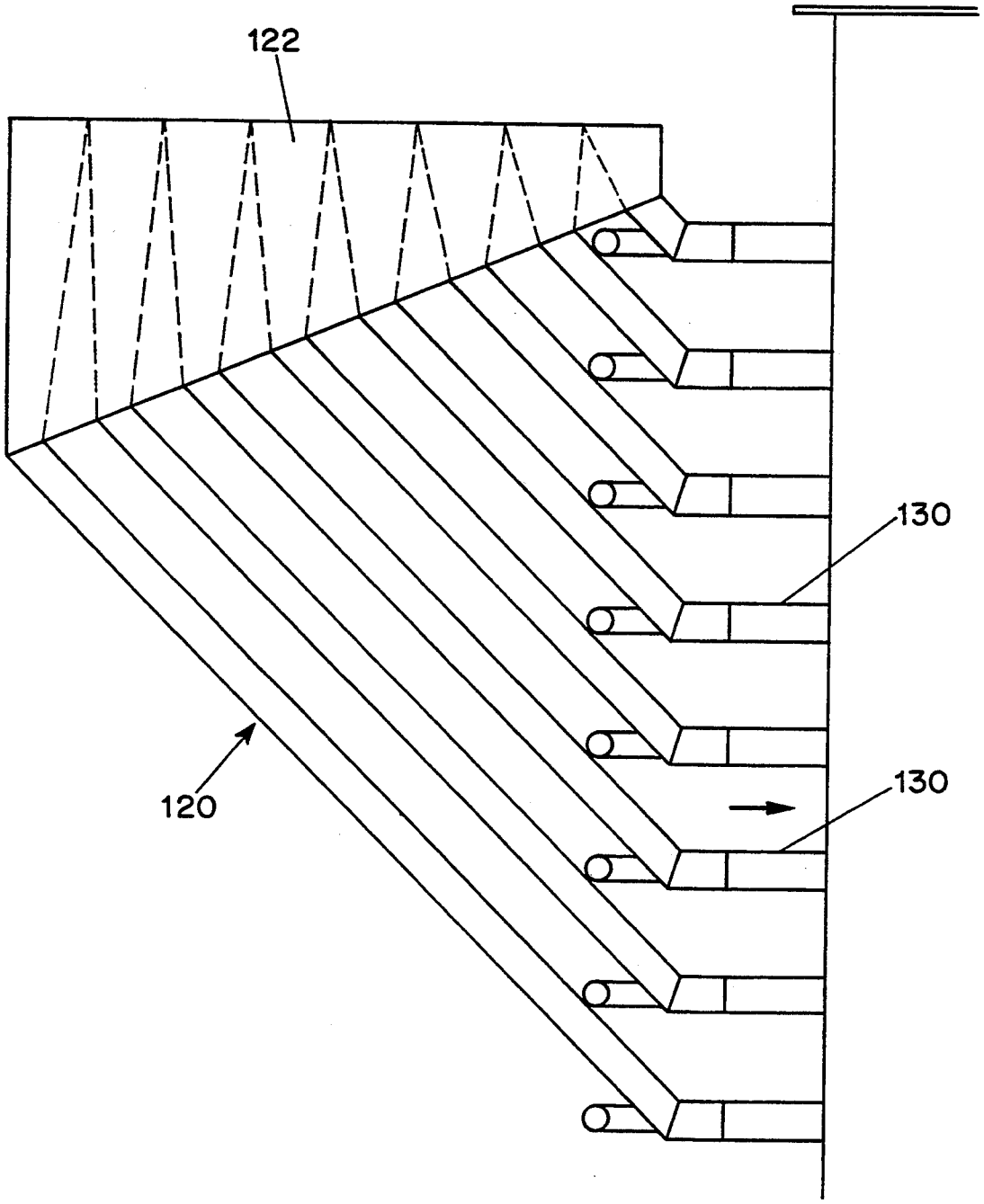
FIG. 9 shows the distributor arrangement of FIG. 8 in more detail.

FIGS. 10 and 11 show schematic arrangements for recirculating the horizontal and vertical air, respectively, and are particularly appropriate for localities having laws or ordinances limiting the amount of cleaning or drying air exhausted to the surrounding atmosphere. It should also be noted that the use of suction fans creates a sub-atmospheric condition in the chamber, minimizing potential damage to the particles.

The turbulence of the vertical stream will cause the floating particles to be shaken up and down and laterally with an oscillating amplitude of perhaps one inch, more or less. This shaking or oscillation does not substantially adversely affect the classification, because the height of each channel is on the order of ten inches and the channel output is in any case checked before switching to grade A or grade B channels, 64*a* or 64*b*. In fact, the shaking may actually improve the cleaning performance.

The invention, as compared to a gravity separator, enables one to clean and classify seeds, grains or other particles with the same purity content, but at a larger capacity than the gravity separator, and without any need to recycle the seeds and thereby not subjecting them to mechanical stress causing broken seeds. The cost of an apparatus according to the invention may be much less than gravity separator arrangements.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An apparatus for cleaning and classifying solid particles having different weights comprising:

a vertical chamber having a top, bottom and side walls;

means for introducing particles of different weights into the chamber;

means for creating a vertically upward suspension airstream in the chamber whose air speed varies with height, to thereby classify the particles by weight at different heights;

a plurality of outlet channel means arranged vertically along the side wall of the chamber for removing particles classified by weight; and means for creating a horizontal conveyor airstream into the chamber which is substantially continuous throughout the vertical extent of the chamber to direct the suspended, classified particles toward the respective outlet channel means.

2. The apparatus according to claim 1, wherein the vertical chamber has a cross-sectional area which increases in the upward direction, and wherein the lighter particles are suspended at a height higher than the heavier particles.

3. The apparatus according to claim 2, further comprising a top converging section connected to the top of the vertical chamber and outlet means at the top of the converging section for collecting and removing particles lighter than particles suspended at the top of the vertical chamber.

4. The apparatus according to claim 3, comprising a plurality of top converging subsections all of which are connected at their respective upper regions.

5. The apparatus according to claim 2, wherein the vertical chamber comprises four side walls comprising two generally parallel walls and two upwardly diverging walls connected to the parallel walls.

6. The apparatus according to claim 5, wherein at least two opposed sidewalls are each curved along at least a portion of the side wall.

7. The apparatus according to claim 5, wherein at least two opposed sidewalls are each straight along at least a portion of the side wall.

8. The apparatus according to claim 5, wherein at least two opposed sidewalls each have a first straight, linear portion, and a second curved portion.

9. The apparatus according to claim 2, wherein the cross-sectional area at the top of the chamber is about two times the cross-sectional area at the bottom of the chamber, to thereby provide a vertical air speed at the bottom of the chamber about two times the vertical air speed at the top of the chamber.

10. The apparatus according to claim 2, including collection means at the bottom of the vertical chamber comprising downwardly diverging walls for collecting and removing relatively heavy particles which do not become suspended in the vertical airstream.

11. The apparatus according to claim 1, wherein the means for introducing particles into the chamber comprises inlet means for introducing particles at the bottom of the chamber.

12. The apparatus according to claim 1, wherein the means for introducing particles into the chamber comprise inlet means for introducing particles at the side of the chamber.

13. The apparatus according to claim 1, wherein the means for creating a vertically upward airstream comprises a suction fan in communication with the top of the chamber.

14. The apparatus according to claim 13, wherein the vertical airstream is about 40 times greater than the horizontal airstream.

15. The apparatus according to claim 1, wherein the vertical airstream is at least one order of magnitude greater than the horizontal airstream.

16. The apparatus according to claim 1, wherein the plurality of outlet channel means comprises a plurality of outlet channels vertically arranged along a side wall the vertical chamber, and outlet collectors connected to the respective outlet channels for collecting the classified particles.

17. The apparatus according to claim 16, wherein at least one of the outlet channels has a bottom wall inclined away from the chamber.

18. The apparatus according to claim 16, wherein at least one of the outlet channels has an outlet valve for adjusting the airflow rate in outlet collectors.

19. The apparatus according to claim 1, wherein the particles are seeds.

20. The apparatus according to claim 1, wherein the chamber includes transparent windows in the side wall for observing the particles in the airstreams.

21. The apparatus according to claim 1, further including means for adjusting the speed of the vertical airstream.

22. The apparatus according to claim 1, further including means for adjusting the speed of the horizontal airstream.

23. The apparatus according to claim 1, wherein eight outlet channel means are provided.

24. The apparatus according to claim 1, further comprising means for homogenizing the vertical airflow along the horizontal extent of the chamber.

25. The apparatus according to claim 1, wherein the means for homogenizing the air flow comprises a fanning flywheel at the bottom of the chamber.

26. The apparatus according to claim 25, wherein the fanning flywheel comprises a shaft having fan segments mounted for rotation at the same speed, said fan segments being separated by disk plates.

27. The apparatus according to claim 24, further comprising a perforated horizontal plate above the fanning flywheel.

28. The apparatus according to claim 1, further comprising at least vertical plate disposed within the chamber extending between opposed sidewalls in a direction transverse to the horizontal airflow, said vertical plate having slots for enabling particles in the horizontal airflow to pass through the slots.

29. The apparatus according to claim 1, further comprising baffle means at the top for adjusting the localized vertical airflow to create uniformity along the horizontal extent of the chamber.

30. The apparatus according to claim 1, wherein at least two opposed sidewalls are continuous along their length.

31. The apparatus according to claim 1, wherein at least two opposed sidewalls are arranged to have steps along their length.

32. The apparatus according to claim 31, wherein the side walls are vertical between the steps.

33. The apparatus according to claim 31, wherein the side walls are inclined between the steps.

34. The apparatus according to claim 1, wherein means for creating a horizontal airstream comprises a suction fan, and further including means for recycling the air removed by said suction fan.

35. The apparatus according to claim 1, wherein means for creating a vertically upward airstream comprises a suction fan, and further including means for recycling the air removed by said suction fan.

* * * * *